United States Patent [19]

Mock

[11] 4,312,166

[45] Jan. 26, 1982

[54] WALL ASSEMBLIES

[75] Inventor: Donald E. Mock, Azusa, Calif.

[73] Assignee: Anjac Plastics, Inc., El Monte, Calif.

[21] Appl. No.: 127,584

[22] Filed: Mar. 6, 1980

[51] Int. Cl.[3] ..... E64G 11/08; E04C 2/32; E04C 2/38

[52] U.S. Cl. ..... 52/522; 52/588; 52/DIG. 3; 249/112; 256/24; 405/281

[58] Field of Search ..... 52/542, DIG. 3, 588, 52/539, 542, 593, 530, 522; 405/278, 277, 276, 281; 249/25, 112; 24/201 C; 256/24

[56] References Cited

U.S. PATENT DOCUMENTS

| | | | |
|---|---|---|---|
| 1,699,213 | 1/1929 | Statler | 52/530 |
| 2,016,064 | 10/1935 | Willner | 405/281 |
| 2,354,485 | 7/1944 | Slaughter | 24/201 C |
| 2,388,297 | 11/1945 | Slaughter | 24/201 C |
| 2,766,861 | 10/1956 | Abramson | 52/530 |
| 3,354,595 | 11/1967 | Abciuk | 52/588 |
| 3,481,094 | 12/1969 | Taylor | 52/585 |
| 3,611,655 | 10/1971 | Loebner | 52/588 |
| 3,611,660 | 10/1971 | Costello | 52/530 |
| 3,664,630 | 5/1972 | Maynen | 249/112 |
| 3,780,977 | 12/1973 | Dashew | 52/588 |
| 3,999,392 | 12/1976 | Fukushima | 405/281 |

OTHER PUBLICATIONS

Sweet's Catalog File 1978, 7.4 Rey, p. 7, by McGraw-Hill Information Co.

*Primary Examiner*—John E. Murtagh
*Attorney, Agent, or Firm*—Edward D. O'Brian

[57] ABSTRACT

Wall assemblies useful for a wide variety of different applications can be economically constructed utilizing extruded polymer panels shaped so as to have sloped positioning walls located adjacent to interlocking connecting elements at their side edges. The connecting elements are shaped so that the connecting element along one side edge of one panel can be pushed into engagement with a connecting element along another side edge of another panel through the use of a tool pressing against the adjacent positioning walls when the side edge of the first of the panels is located over the side edge of the other panel.

1 Claim, 2 Drawing Figures

WALL ASSEMBLIES

BACKGROUND OF THE INVENTION

The invention set forth in this specification pertains to new and improved wall assemblies useful as fences, panels, as mobile home skirting, as tree guards, as concrete form liners and the like.

Wall assemblies of the type to which this invention pertains are commonly utilized where it is necessary or desirable to provide a relatively inexpensive, impervious or relatively impervious wall surface. Prior related wall assemblies have been manufactured in many different manners. At the present time it is considered quite desirable from an economic standpoint to manufacture such wall assemblies from a series of individual extruded plastic or polymer panels capable of being assembled together so as to form a complete panel, wall or wall assembly.

There are, of course, many ways of connecting the adjacent side edges of such panels in a side edge to side edge relationship to form a complete wall assembly. At the present time it is considered most advantageous from an economic standpoint to construct such extruded panels so that they can be assembled together through the use of interlocking elements which can be snapped together as a result of the inherent resiliency of the polymer material used in constructing such panels. In general it is considered that such prior interlocking elements have been constructed so as to utilize a somewhat greater amount of material than desirable. Such use of such amounts of material is, of course, disadvantageous from an economic standpoint. Also it is considered that in general such prior connecting elements have been constructed in such a manner that they cannot be as conveniently and easily connected together as is desirable from an economic standpoint.

SUMMARY OF THE INVENTION

As a result of these considerations it is considered that there is a need for new and improved wall assemblies formed out of extruded polymer panels. Broadly the invention set forth in this specification is intended to fulfill this need. More specifically the invention is intended to provide wall assemblies of the type indicated: which can be economically constructed using comparatively inexpensive, comparatively light weight extruded panels, which may be easily and conveniently assembled from such panels, and which are capable of being utilized in a wide variety of different, diverse applications.

In accordance with this invention these various objectives are achieved by providing a wall assembly including a series of at least two panels located in side edge to side edge relationship, each of said panels having a front and a back, each of said panels having a first edge and a first connecting means extending along the length of its first side edge and each of said panels having a second side edge and a second connecting means extending along the length of its second side edge, side edges of said panels in said assembly being connected by engagement between first and second connecting means on adjacent of said panels, in which the improvement comprises:

each panel including a back wall adjacent to its first side edge and a positioning wall connected to its back wall and spaced from its first side edge and including a second positioning wall leading from its second side edge, said first and second connecting means, said back wall, and said first and said second positioning walls on each of said panels being of uniform cross-sectional configuration along their lengths, said first positioning wall on each of said panels extending parallel to the first side edge of such panel and being spaced from said first side edge of such panel by said back wall and sloping outwardly from the back of such panel, said first connecting means on each of said panels comprising a retaining flange extending generally away from said back wall at said first edge of such panel generally toward the front of such panel and then along the back wall of such panel so as to overlay said back wall of such panel to define an elongated retaining opening, said second positioning wall on each of said panels extending from said second side edge of such panel toward the front of such panel and sloping outwardly from the back of such panel, said second connecting means on each of said panels comprising a retained flange extending from said second side edge of such panel at an extremity of said second positioning wall of such panel generally toward said first side edge of such panel, said retained flanges being capable of being pushed into said retaining openings so as to connect adjacent of said panels into side edge to side edge relationship with one another, said first and said positioning walls on each of said panels being sloped from adjacent to the back of such panel to adjacent to the front of such panel at an acute angle with respect to one another, said positioning walls being sloped with respect to one another so as to permit two of said panels to be assembled with respect to one another by placing the retained flange on one of said panels on said back wall of the other of said panels adjacent to the retaining opening an the other of said panels so that as a downward pressure is applied to the positioning walls adjacent to the so located panels a force component will be exerted which forces the retained flange on the first of such panels into engagement with the retaining flange within said retaining opening on the other of said panels.

BRIEF DESCRIPTION OF THE DRAWING

Because of the nature of this invention it is best described with reference to the accompanying drawing in which.

Figure 1:
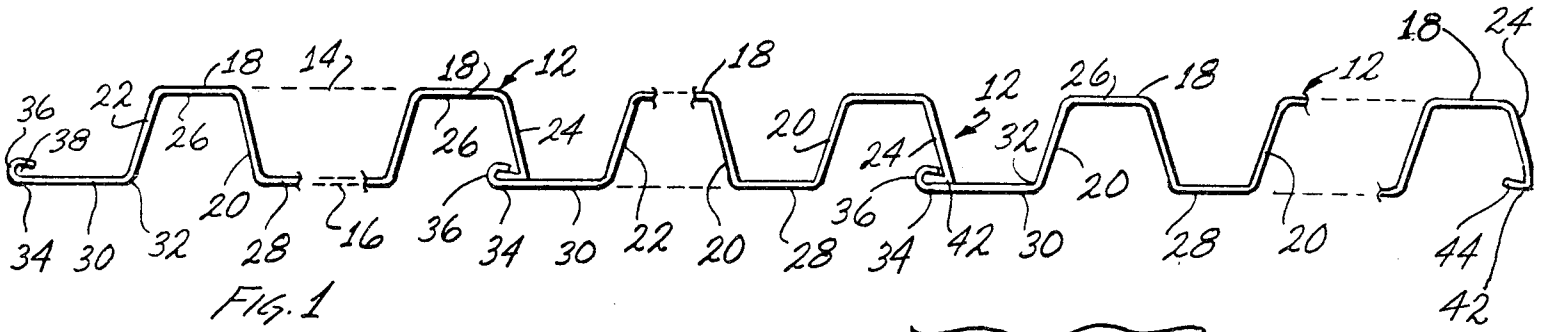
FIG. 1 is an end elevational view of a presently preferred embodiment or form of a wall assembly of the present invention which, as illustrated, consists of three panels but which can consist of any number of panels in excess of one connected together as hereinafter described.

The invention set forth in this spcification utilizes the operative concepts or principles set forth in the claims annexed to this specification. It will be realized that these concepts or principles can be employed within a variety of somewhat differently appearing and differently constructed wall panels through the use or exercise of routine engineering skill. As an example of this the configuration of individual wall panels within a complete wall assembly between the side edges of such panels may be varied to a significant extent.

DETAILED DESCRIPTION

In the drawing there is shown a wall assembly 10 consisting of a series of three identically formed panels 12 which are preferably formed by cutting off lengths of a continuous extrusion of a polymer material such as comparatively rigid polyvinyl polymer material or the like. When so formed each of the panels 12 is constructed so as to have an identical cross-sectional configuration or profile extending along its length.

The various individual panels 12 are intended to have a front 14 and a back 16 separated by what in effect is a single sheet (not numbered) of formed, rigid material as hereinafter noted. The panels 12 are constructed so as to include a type of elongated corrugations 18 as shown. These corrugations 18 include sloping walls 20, 22 and 24 connected by front walls 26 as shown in the drawing. The corrugations 18 are also connected by back walls 28 extending between the sloping walls 20. It will be noted that the particular sloping walls at the left-hand sides of the panels 12 are designated by the numeral 22 and that the sloping walls at the right-hand sides of the panels 12 are designated by the numeral 24. Except for these designations the walls 22 and 24 are the same as the walls 20. The wall 22 may be referred to as a first positioning wall 22 because of its function as hereinafter indicated. Similarly the wall 24 may be referred to as a second positioning wall 24 because of its function as hereinafter indicated.

A back wall 30 corresponding to the other back walls 28 extends from an edge 32 of each positioning wall 22 outwardly from the remainder of each panel 12 in the same plane or in substantially the same plane as the various walls 28. Each of the back walls 30 terminates in a first side edge 34 remote from the corrugations 18 on the panel 12 upon which it is located. Attached to the edge 34 in each of the panels 12 is a retaining flange 36 serving as a first connecting means. As will be noted in FIG. 2 of the drawing the retaining flanges 36 are curved up from the side edges 34 so as to extend generally frontwardly from the back 16 and then generally over the side edge 34 and over a part of the back wall 30 so as to define an elongated retaining opening 38. It will be noted that the retaining flange 36 terminates in an edge 40 of a somewhat curved or rounded configuration. The space between this edge 40 serves as an entrance (not separately numbered) into the retaining opening 38. Preferably the retaining openings 38 is made by sloping the flange 36 slightly as shown so that it is of slightly larger cross-sectional dimension internally than it is adjacent to the edge 40.

Each second positioning wall 24 has an edge 42 which serves as a second side edge of the panel 12 upon which it is located. Retained flanges 44 are located on these second side edges 42 so as to extend generally along the backs 16 of the panels 12 toward the walls 28. These retaining flanges 44 are preferably shaped so as to fit closely within the restricted openings 38. These retained flanges 44 preferably conform to the shape of the retaining openings 38.

During the construction of a complete wall assembly 10 a retained flange 44 on one panel 12 is located on the back wall 30 of another panel 12 so as to be immediately adjacent to the edge 42 on this other panel 12. At this time it is considered preferable to cause engagement of the retained flange 44 within the adjacent retaining opening 38 by pressing against the two adjacent positioning walls 22 and 24 of the two panels 12 being connected so as to force the retained flange 44 on the first panel 12 being assembled generally within the retaining opening 38 and the retaining flange 36 on the second panel 12.

Figure 2:
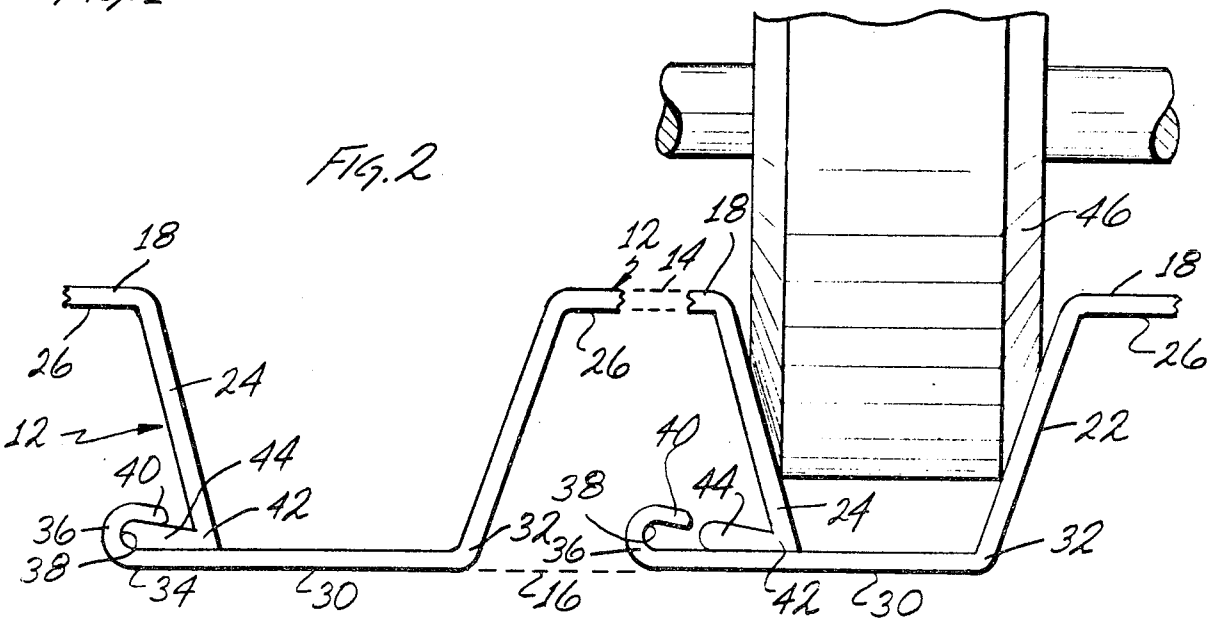
FIG. 2 is an end elevational view corresponding to part of FIG. 1 at an enlarged scale showing the assembly of adjacent side edges of two panels together.

It is considered important that the particular walls 22 and 24 are sloped as shown so that the two of these walls 22 and 24 on any particular panel 12 are located at an acute angle to one another. Such sloping of the walls 22 and 24 makes it convenient to utilize a beveled roller 46 as indicated in FIG. 2 of the drawing in such a manner that as the roller 46 is pressed downwardly it engages the walls 22 and 24 adjacent to where the flanges 36 and 44 are being connected so as to cause a force component which forces the flange 44 within the flange 36. Normally such connection of the two flanges involves some momentary temporary deformation or snapping.

The nature of the joint (not separately numbered) formed by locating a retained flange 44 within a retaining flange 36 created as indicated in the preceding can be improved by locating a conventional adhesive (not shown) within the retaining opening 38. If desired the surface of the flange 36 within the opening 38 or the surface of the retained flange 44 may be roughened slightly so as to facilitate adhesion of the adhesive. Preferably such roughened surfaces are used in connection with an adhesive so as to form the complete assembly 10 because of the relative strength of the connection between adjacent panels 12 in such a wall assembly 10. The nature of the connection between the flanges 36 and 44 is such that the flange 44 may be easily welded into place utilizing a continuous rotary ultrasonic welding tool if this is desired.

I claim:

1. A wall assembly including a series of at least two panels located in side edge to side edge relationship, each of said panels having a front and a back, each of said panels having a first edge and a first connecting means extending along the length of its first side edge and each of said panels having a second side edge and a second connecting means extending along the length of its second side edge, side edges of said panels in said assembly being connected by engagement between first and second connecting means on adjacent of said panels, in which the improvement comprises:

each panel including a back wall adjacent to its first side edge and a positioning wall connecting to its back wall and spaced from its first side edge and including a second positioning wall leading from its second side edge, said first and second connecting means, said back wall, and said first and said second positioning walls on each of said panels being of uniform cross-sectional configuration along their lengths, said first positioning wall on each of said panels extending parallel to the first side edge of such panel and being spaced from said first side edge of such panel by said back wall and sloping outwardly from the back of such panel, said first connecting means on each of said panels comprising a retaining flange extending generally away from said back wall at said first edge of such panel generally toward the front of such panel and then along the back wall of such panel so as to overlay said back wall of such panel to define an elongated retaining opening, said second positioning wall on each of said panels extending from said second side edge of said panel toward the front of such panel and sloping outwardly from the back of such panel, each of said retaining openings is of larger cross-sectional dimension internally than it is adjacent to its entrance, said second connecting means on each of said panels comprising a retained flange extending from said second side edge of such panel at an extremity of said second positioning wall of such panel generally toward said first side edge of such panel, said retained flanges having rounded edges being capable of being pushed into said retaining openings so as to connect adjacent of said panels into side edge to side edge relationship with one another, each of said retained flanges is shaped so as to conform to the shape of said internal openings, said first and said positioning walls on each of said panels being sloped from adjacent to the back of such panel to adjacent to the front of such panel at an acute angle with respect to one another, said positioning walls being sloped with respect to one another so as to permit two of said panels to be assembled with respect to one another by placing the retained flange on one of said panels on said back wall of the other of said panels adjacent to the retaining opening on the other of said panels so that as a downward pressure is applied to the positioning walls adjacent to the so located panels a force component will be exerted which forces the retained flange on the first of such panels into engagement with the retaining flange within said retaining opening on the other of said panels, said panels are formed of a somewhat resilient material capable of being temporarily deformed so as to permit said retained flanges to be snapped into said retaining openings, adhesive means located between said retained flanges and the interiors of said retaining openings.

* * * * *